United States Patent [19]

Norden

[11] 4,358,650

[45] Nov. 9, 1982

[54] CIRCUIT BREAKER

[75] Inventor: Alexander R. Norden, New York, N.Y.

[73] Assignee: GTE Laboratories Incorporated, Waltham, Mass.

[21] Appl. No.: 227,888

[22] Filed: Jan. 23, 1981

[51] Int. Cl.[3] ..... H01H 3/00; H01H 25/00

[52] U.S. Cl. ..... 200/153 H; 200/153 G; 200/154

[58] Field of Search ..... 200/153 G, 153 H, 154, 200/325, 324, 74, 73

[56] References Cited

U.S. PATENT DOCUMENTS

| | | | |
|---|---|---|---|
| 3,293,397 | 12/1966 | Zubaty et al. | 200/153 G |
| 4,165,453 | 8/1979 | Henneman | 200/153 G |

FOREIGN PATENT DOCUMENTS

| | | | |
|---|---|---|---|
| 1563781 | 4/1970 | Fed. Rep. of Germany | 200/153 G |
| 1350385 | 12/1963 | France | 200/153 H |

*Primary Examiner*—Willis Little

*Attorney, Agent, or Firm*—Fred Fisher

[57] ABSTRACT

During "ON" operation, the lengths of the arms of a toggle are essentially fixed; during "TRIP" operation, the length of at least one arm is effectively shortened. The toggle operates, in "ON" condition, with one arm pivotally coupled to a second arm about a fixed pivot point adjacent to a channel with respect to the second arm. In "TRIP" condition, the one arm is pivotally coupled to the other arm about at least one pivot point lying within the channel. A spring couples the two arms which are pivoted together: in "normal" conditon, one arm is pivoted about a substantially fixed point with respect to the other arm; in "TRIP" condition, one arm is pivoted about a locus of points with respect to the second arm distant from the substantially fixed point. A stationary contact is held by an insulated circuit breaker housing. A handle is pivoted about a fixed pivot point on the housing and is limited in arcuate motion by the housing. A contact arm, having a contact affixed thereto, has an attachment means, a projection, and a pocket with at least one corner. A latch normally blocks one corner of the pocket so as to provide a corner opening for reception of a portion of a link which extends from the handle. The latch, when actuated, unblocks the corner to permit the portion of the link to exit from the opening. A spring couples the attachment means to the housing so as to urge the contact arm toward the fixed pivot point. In "ON" condition, the latch blocks the one corner of the pocket and the contacts are engaged. Upon actuation of the latch, the one corner unblocks, and the portion of the link exits from the corner opening, whereupon the projection engages with a housing barrier, causing the contact arm to at least partially pivot thereabout, opening the contacts.

5 Claims, 10 Drawing Figures

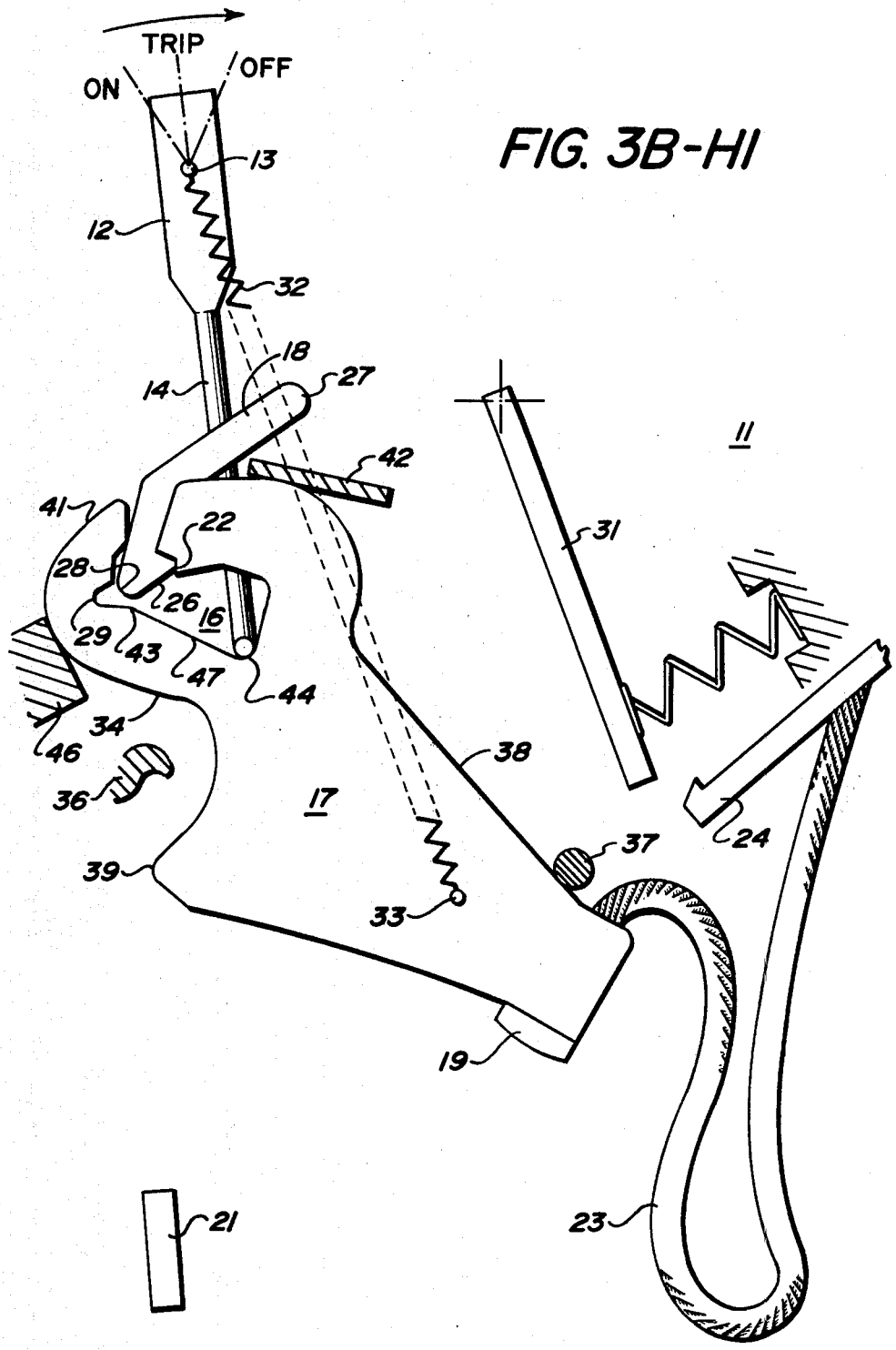
FIG. 3B-HI

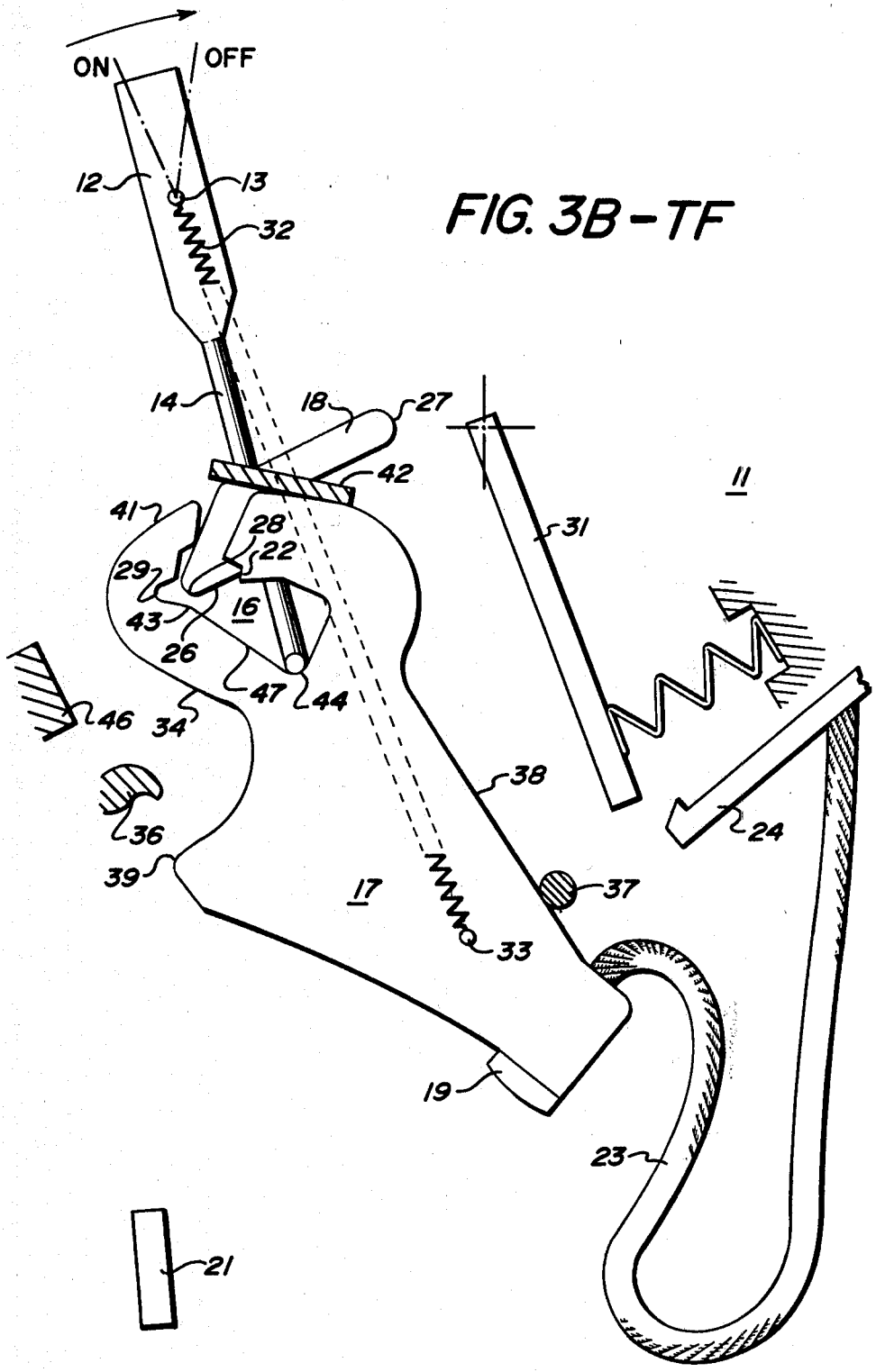
FIG. 3B-TF

CIRCUIT BREAKER

BACKGROUND OF THE INVENTION

This invention relates to circuit breakers. It is a general object of this invention to provide new and improved circuit breaker mechanisms.

This invention, especially suitable for use in circuit breaker housings of a size commonly used by the electrical industry for its residential circuit breakers, does not rely critically on housing dimensions for its functionality. Thus, it can perform consistently in a variety of housing designs. Advantageously, a circuit breaker should be quick-made, quick-break in action, must be trip-free under overload conditions, and it should trip instantaneously (magnetically) at about 1200 to 1500 percent of breaker rating, preferably without requiring elaborate and thus costly magnetic structures. It should further lend itself to inexpensive manufacture and easy assembly.

In order to permit reasonable housing wall thicknesses and operating clearances in a variety of housings, the width of the mechanism must be minimized. Magnetic operation at low current values requires low unlatching forces. "Switching duty" requirements call for higher contact pressures and contact "wipe" action. Functioning in a variety of housings, and, hence adaptability to varying locations and forms of line and load connections and handle configurations, suggests either an integrated mechanism—trip unit assembly; or a mechanism and a trip unit, the spatial relationship between which is not overly critical. This invention is based on the latter concept.

SUMMARY OF THE INVENTION

An object of this invention is to provide for a new and improved circuit breaker mechanism which is small and is versatile for use in different housings.

Another object of this invention is to provide for a new and improved circuit breaker mechanism which is snap acting.

Still another object of this invention is to provide for a new and improved circuit breaker mechanism having a toggle which is quickly collapsible.

Still yet another object is to provide substantial contact pressures and contact wiping action.

In accordance with one embodiment of the invention, a circuit breaker includes a housing and a stationary contact affixed to the housing. A handle is adapted to be pivoted about a fixed pivot point of the housing. A link extends from the handle. A contact arm has an attachment means, a projection, and a pocket having at least one corner. Latching means are provided which are adapted to normally block one corner of the pocket so as to provide an opening for reception of a portion of the link. The latching means, when actuated, is adapted to unblock the corner so as to permit the portion of the link to enter the remainder of the pocket. A tension spring is coupled between the attachment means and the fixed pivot point. A minimum distance between the attachment means and the pivot point is provided. A contact is affixed to the contact arm and a barrier is affixed to the housing. In a normal "ON" condition, the latching means blocks the corner of the pocket and the contacts are engaged. Upon actuation of the latching means, the corner becomes unblocked, permitting the portion of the link to enter the remainder of the pocket, whereupon the projection engages with the barrier, causing the contact arm to at least partially pivot thereabout, opening the contacts.

In accordance with another embodiment of the invention, a circuit breaker includes an insulated housing having a fixed pivot point, a barrier affixed therewithin, and means for limiting arcuate motion of a handle. A stationary contact is held by the housing. A handle is adapted to be pivoted about the fixed pivot point, and is adapted to be limited in arcuate motion by the limiting means. A link extends from the handle. A contact arm has an attachment means, a projection, and a pocket having at least one corner. Latching means are provided which are adapated to normally block one corner of the pocket so as to provide a corner opening for reception of a portion of the link. The latching means, when actuated, is adapted to unblock the one corner so as to permit the portion of the link to exit from the corner opening. A contact is affixed to the contact arm. A spring is coupled to the attachment means and to the housing so as to urge the contact arm toward the fixed pivot point. In a normal "ON" condition, the latching means blocks the one corner of the pocket and the contacts are engaged. Upon actuation of the latching means, the one corner becomes unblocked, permitting the portion of the link to exit from the corner opening, whereupon the projection engages with the barrier, causing the contact arm to at least partially pivot thereabout, opening the contacts.

In accordance with still another embodiment of the invention, in a circuit breaker mechanism, a new and improved toggle mechanism is described, including a first arm, a second arm, a spring coupling the first arm to the second arm, and means for pivoting the first arm with respect to the second arm. The improvement resides in the means wherein, in a normal condition, the means provides for pivoting the first arm with respect to the second arm about a substantially fixed point with respect to the second arm. In an actuated condition, it provides for pivoting the first arm with respect to the second arm about at least one point with respect to the second arm distant from the substantially fixed point.

In yet another embodiment of the invention, in a circuit breaker mechanism, an improved toggle mechanism includes a first arm, a second arm having a channel therewithin, a spring coupling the arms together, and means for pivotally coupling the first arm to the second arm. The improvement resides in that, in a normal "ON" condition, the first arm is pivotally coupled to the second arm about a fixed pivot point adjacent to the channel with respect to the second arm. In a "TRIP" condition, the first arm is pivotally coupled to the second arm about at least one pivot point lying within the channel.

In still yet another embodiment of the invention, in a circuit breaker mechanism, an improved toggle mechanism including a first arm having a connection point and a pivotal coupling, the distance between the connection point and the pivotal coupling being a first length, and a second arm having a connection point and having a pivotal coupling coupled to the first arm pivotal coupling, the distance between the second arm connection point and the second arm pivotal coupling being a second length, is set forth, together with a spring coupling the first arm connection point and the second arm connection point, and suitable means. The suitable means is operative during a normal "ON" condition for maintaining both the first length and the second length essentially fixed. The suitable means is operative during a "TRIP" condition for effectively shortening at least one of the first length and the second length.

BRIEF DESCRIPTION OF THE DRAWINGS

Other objects and advantages of this invention, together with its construction and mode of operation, will become more apparent from the following description, when read in conjunction with the accompanying drawings, in which:

FIGS. 1A, 1B, and 1C are plan views of one embodiment of the invention showing the improved circuit breaker, with the cover removed, in which FIG. 1A depicts the mechanism in the "ON" condition, FIG. 1B shows the mechanism in the "toggle" position, and FIG. 1C shows the mechanism in the "OFF" position;

FIGS. 3A, 3BTF, 3BHI, and 3C show the mechanism operating in the "tripping" mode, the circuit breaker being shown in its essential parts with the cover removed, wherein FIG. 3A depicts the mechanism prior to the "tripping" action and FIG. 3C depicts the mechanism reset, by manually moving the handle to "OFF", subsequent to the "tripping" action. FIG. 3BTF shows the circuit breaker with a "trip free" action with a handle held in the "ON" position, and FIG. 3BHI shows "handle indicating" trip position of the mechanism, when the handle is either not held, or released after the mechanism is tripped.

DESCRIPTION OF PREFERRED EMBODIMENTS

Figure 1A:
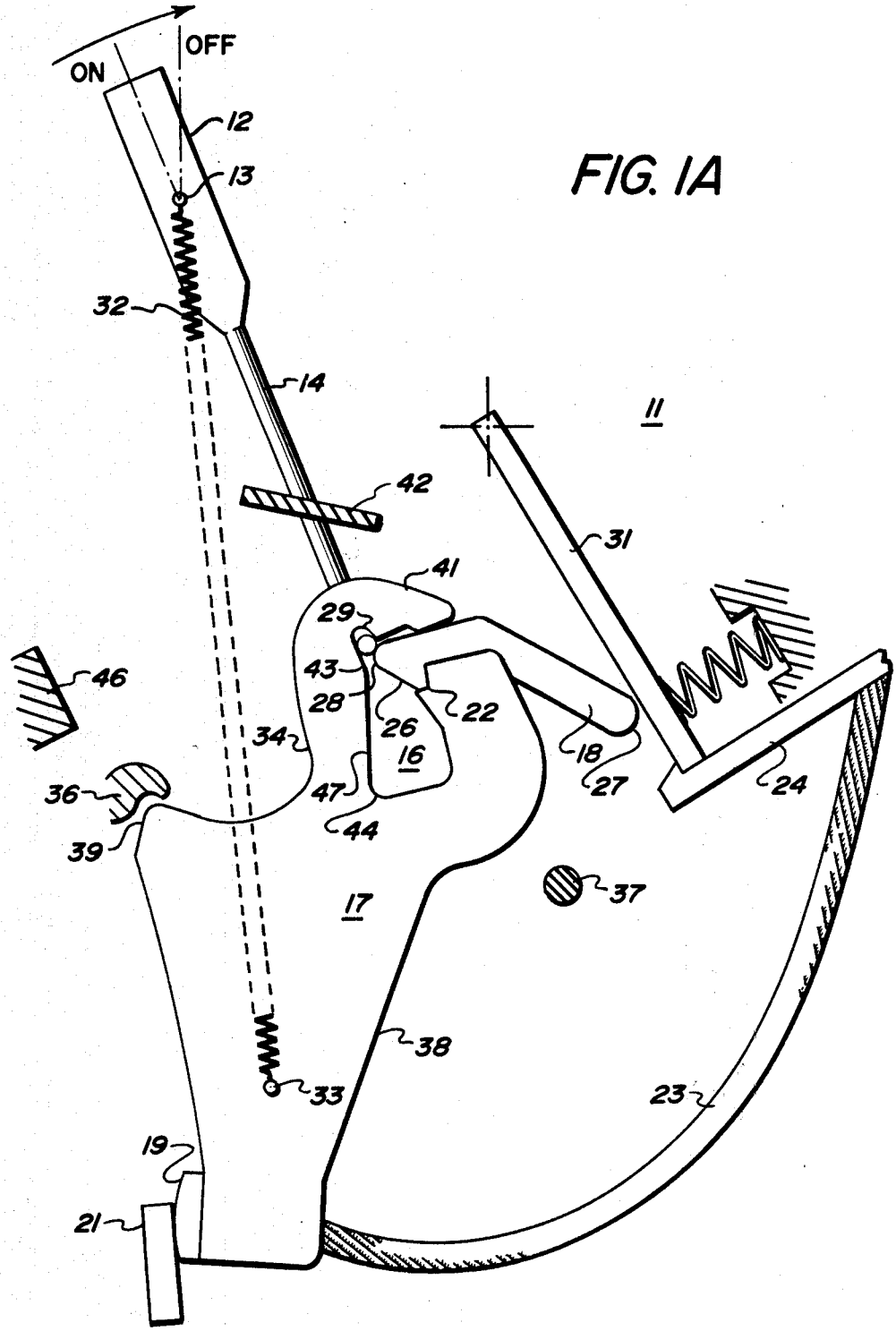

The drawings depict various views of the circuit breaker in accordance with the preferred embodiment of the invention. All of the views are plan views which illustrate the essential characteristics of the various components. The insulated housing 11 is depicted generally in the drawing without any delineation of its boundaries so as to simplify an understanding of this invention. The plan view of the drawing, which shows the handle 12, does not indicate its thickness with relationship to the paper as viewed or, for that matter, whether or not the handle 12 is curved, rather than being sharp at its corners. The handle 12 can have a suitable thickness internal to the housing 11, depending upon the designer thereof. It can be thicker and wider as the handle extends from the housing, if so desired. In similar fashion, the link 14 can have other configurations as so desired, and, optionally, the contact arm 17, by way of example, can be relatively flat except for welding or guide projections. The handle 12, preferably, is nonconductive or insulated as is the housing 11. The contact arm 17 is a conductor as are, of course, the contacts 19 and 21.

Referring to the drawing, a circuit breaker mechanism, in accordance with a preferred embodiment of the invention, provides switching (on-off) action, and is capable of tripping action (on-off). It includes the following elements:

1. An insulating housing 11 (not shown in detail) for the mechanism provides a pivot point 13 for a handle 12, limit stops for movement of the handle 12, limit stops 36, 37 and camming surfaces 42, 46 for contact arm 17 movement, stationary contact 21 mounting, and current-responsive trip unit 24 mounting.

2. The handle 12 is constructed of insulating material, pivoted at the point 13 and movable between on and off positions.

3. A link 14, preferably of hard steel wire, is pivoted at the point 13 and is rigidly connected to the handle 12. The other end of the link 14 is retained within an essentially triangular pocket 16, formed by a notch in the contact arm 17, and is closed off by the trip latch 18.

4. The contact arm 17 is moved between on and off positions by the link 14 at one end and carries a contact 19 at the other end. In the "ON" position, the arm 17 bears against the stationary contact 21 in the housing 11; a "V"-notched end 22 pivotally supports the trip latch 18. The contact arm 17 is connected through a flexible braid 23 to the current-sensitive trip unit 24.

5. The stationary contact 21 is arranged for connection to a circuit terminal (not shown).

6. The trip latch 18 is made of spring steel, one end 26 forming a leg arranged to pivot in the "V"-notch 22 in the contact arm 17, the other end being formed into a "U"-shape 27. The trip latch 18 is resiliently biased to stay in the position shown by the solid outline, in which the trip latch 18 face 28 blocks an inverted "U"-shaped opening 29 in the contact arm 17. The trip latch 18 is capable of being elastically deflected to the position shown in dotted lines (FIG. 3A), in which the trip latch 18 no longer blocks the "U"-shaped opening 29.

Figure 3A:
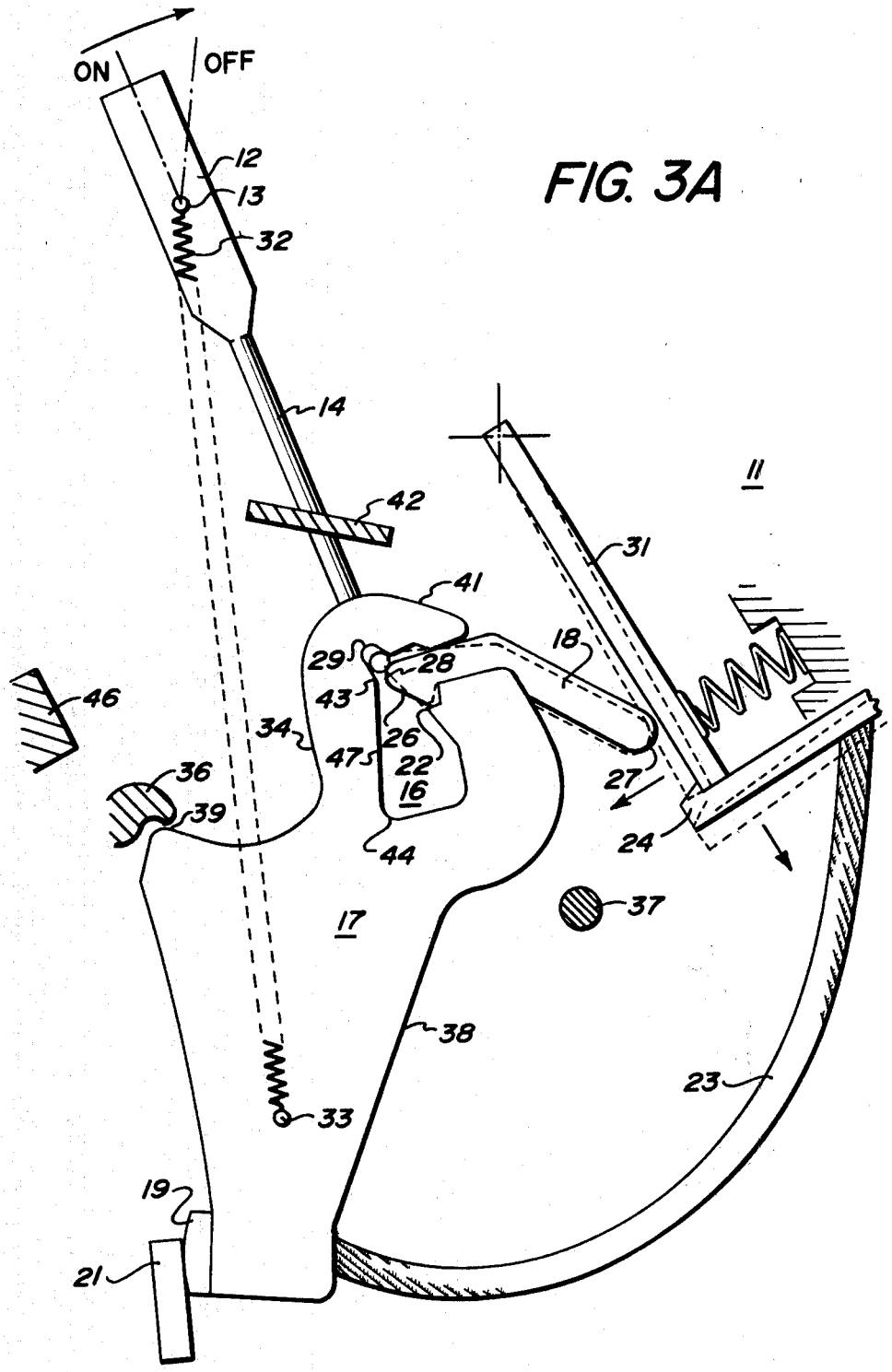

7. The trip unit 24, arranged for connection to a circuit terminal (not shown), includes a spring-loaded pivoted member 31, which, upon actuation due to current over-load and release, strikes the trip latch 18, making it pivot to the dotted-outline position (FIG. 3A).

8. A tension spring 32 has one end pivoted at or near the pivot 13, the other end being resiliently extended to hook on the contact arm 17 at the attachment opening 33. The extended spring 32 urges the contact arm 17 toward the pivot 13.

Figure 1B:
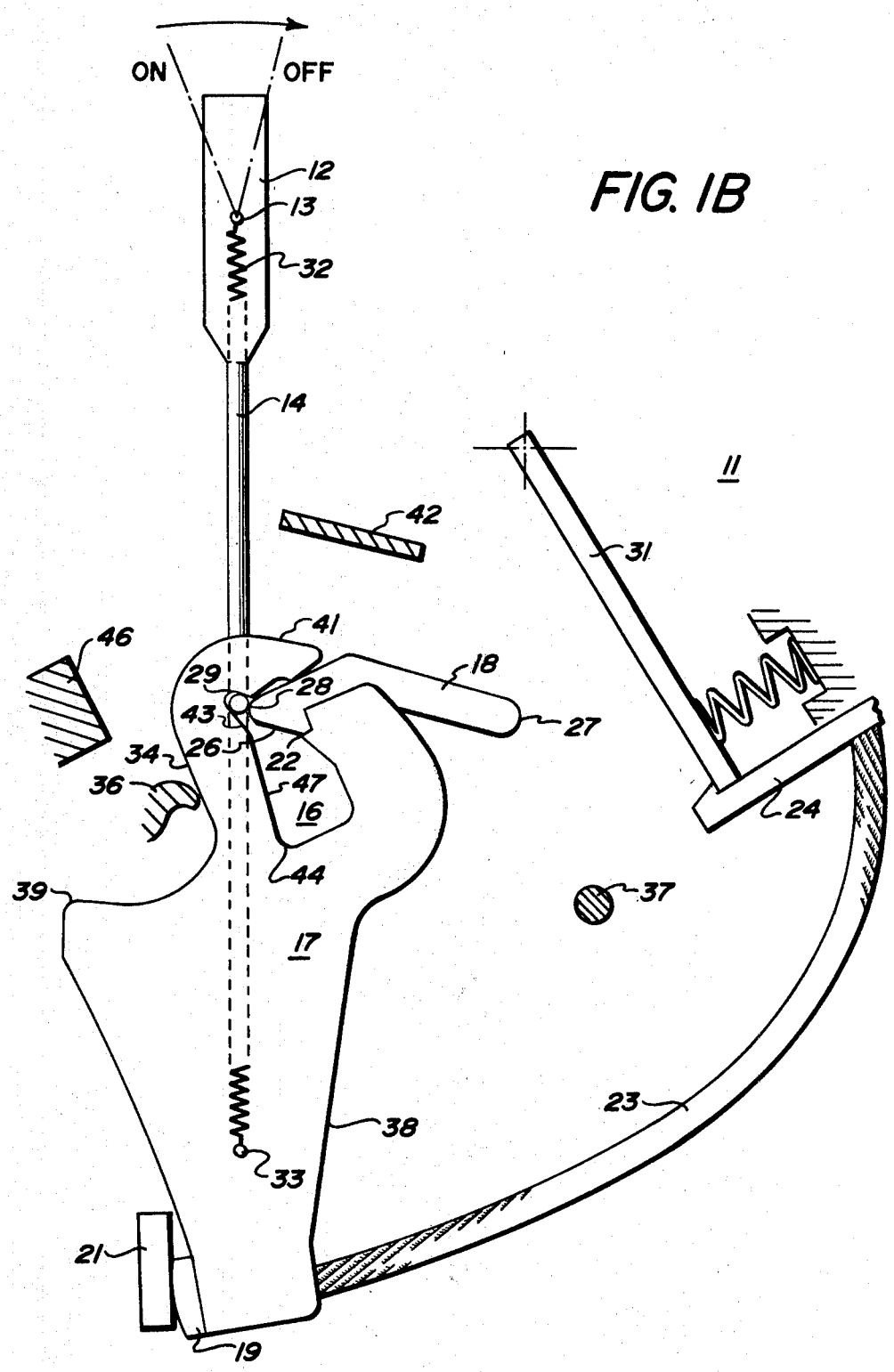
Figure 1C:
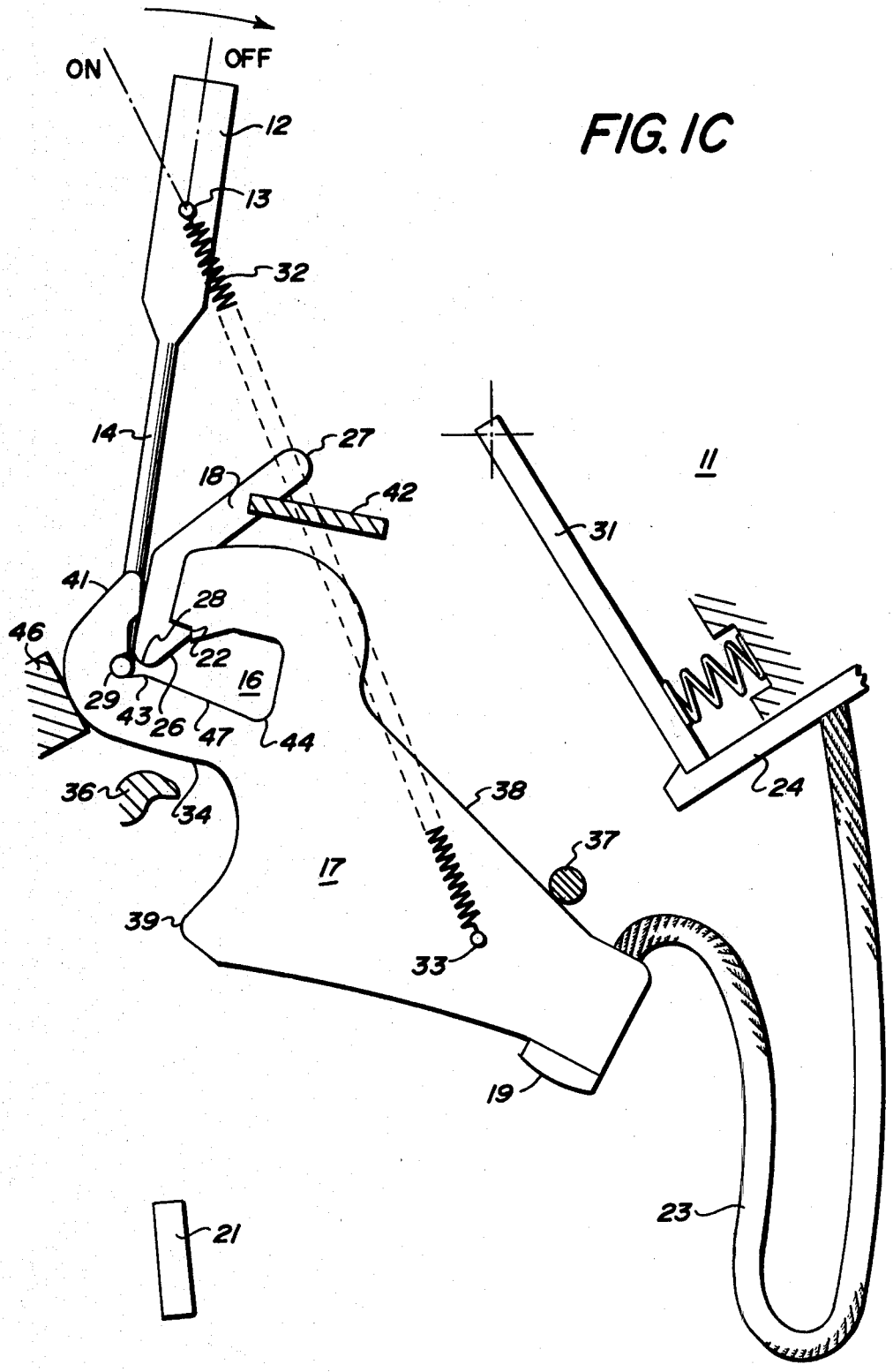

FIGS. 1A, 1B, and 1C show the mechanism in "On" switching through a "toggle" position, to "OFF", respectively. In "ON" (FIG 1A), the end of link 14, contained in the pocket formed by the face 28 and the opening 29, forms a pivot for the contact arm 17. A line joining the pivot 13 and attachment opening 33 is axial with the direction of spring 32 force, and the distance between the U-shaped opening 29 and that line represents a torque arm. Thus, it is apparent that a substantial component of the force urges the contact 19 toward the contact 21, providing contact pressure. It is further noted that in "ON", the lower portion of the contact 19 presses against the upper portion of the contact 21.

As the handle 12 is rotated toward "OFF", the link 14 is rotated clockwise about the pivot 13. A toggling position is reached as shown in FIG. 1B. At this time, it is the upper portion of the contact 19 which bears against the lower portion of contact 21, so that, when the contacts 19, 21 part, arcing occurs on those surfaces, thus tending to keep such arcing away from the normal contacting faces. Further, the travel of the contact 19 across the face of the contact 21, wipes that face under pressure, tending to remove arcing deposits and to provide low-resistance contacting surfaces.

At the point of overtoggle, the edge 34 of the contact arm 17 comes in contact with a molded hook 36 of the insulating housing. Should friction prevent overtoggling, continuation of the handle 12 movement toward "OFF" makes the hook 36 a secondary pivot point for the contact arm 17, causing rapid overtoggling, with the contact arm 17 rotating counterclockwise, until it reaches a stop 37 of the housing 11. At that point, a substantial gap exists between the contacts 19 and 21, the gap being approximately equal to two-thirds of the effective contact arm 17 length.

Figure 2A:
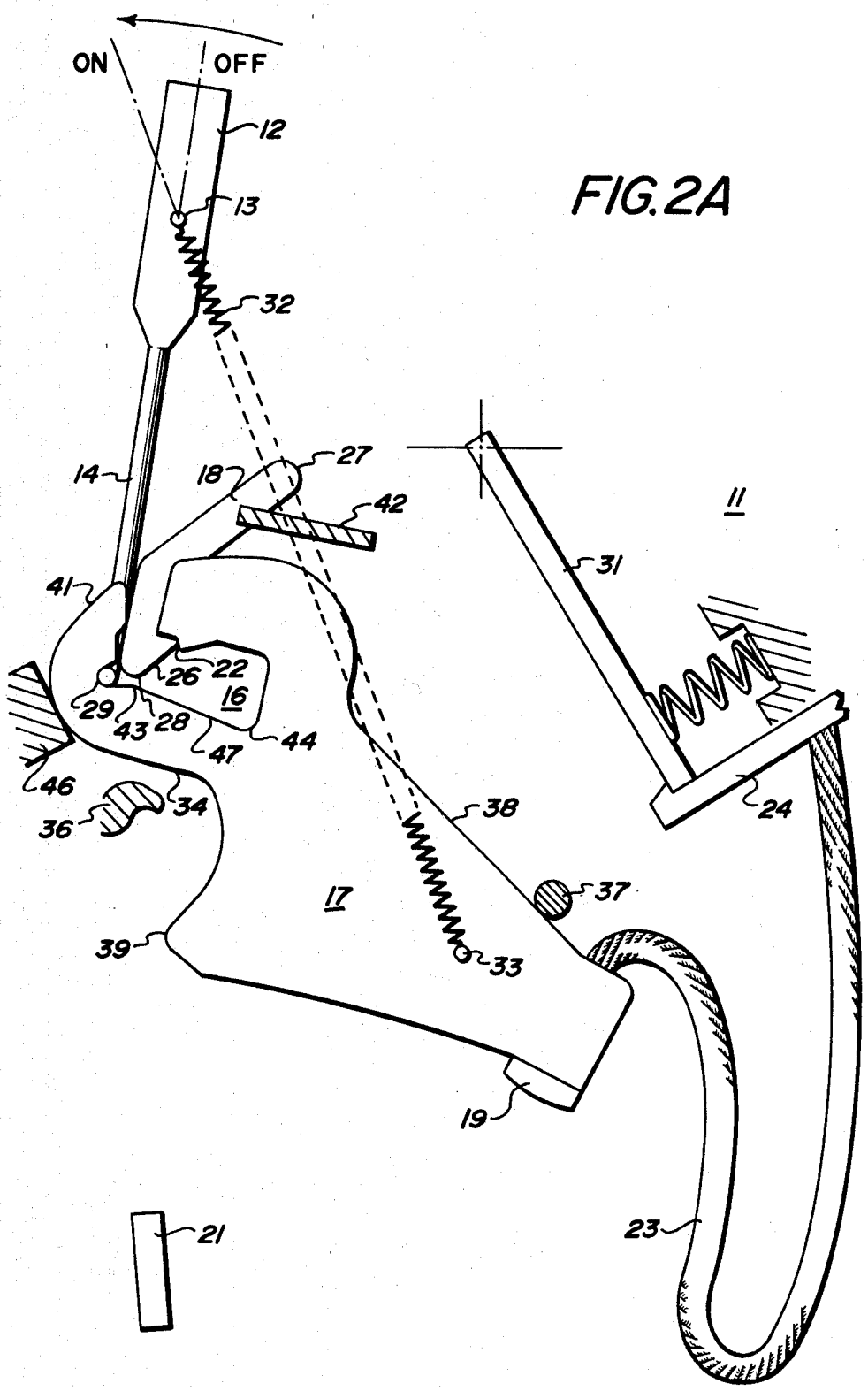
FIGS. 2A, 2B and 2C serially show the embodiment of the invention, with the cover removed, showing the essential portions of the circuit breaker, illustrating the mechanism being switched from the "OFF" through an "overtoggle" position, to the "ON" position, respectively.
Figure 2B:
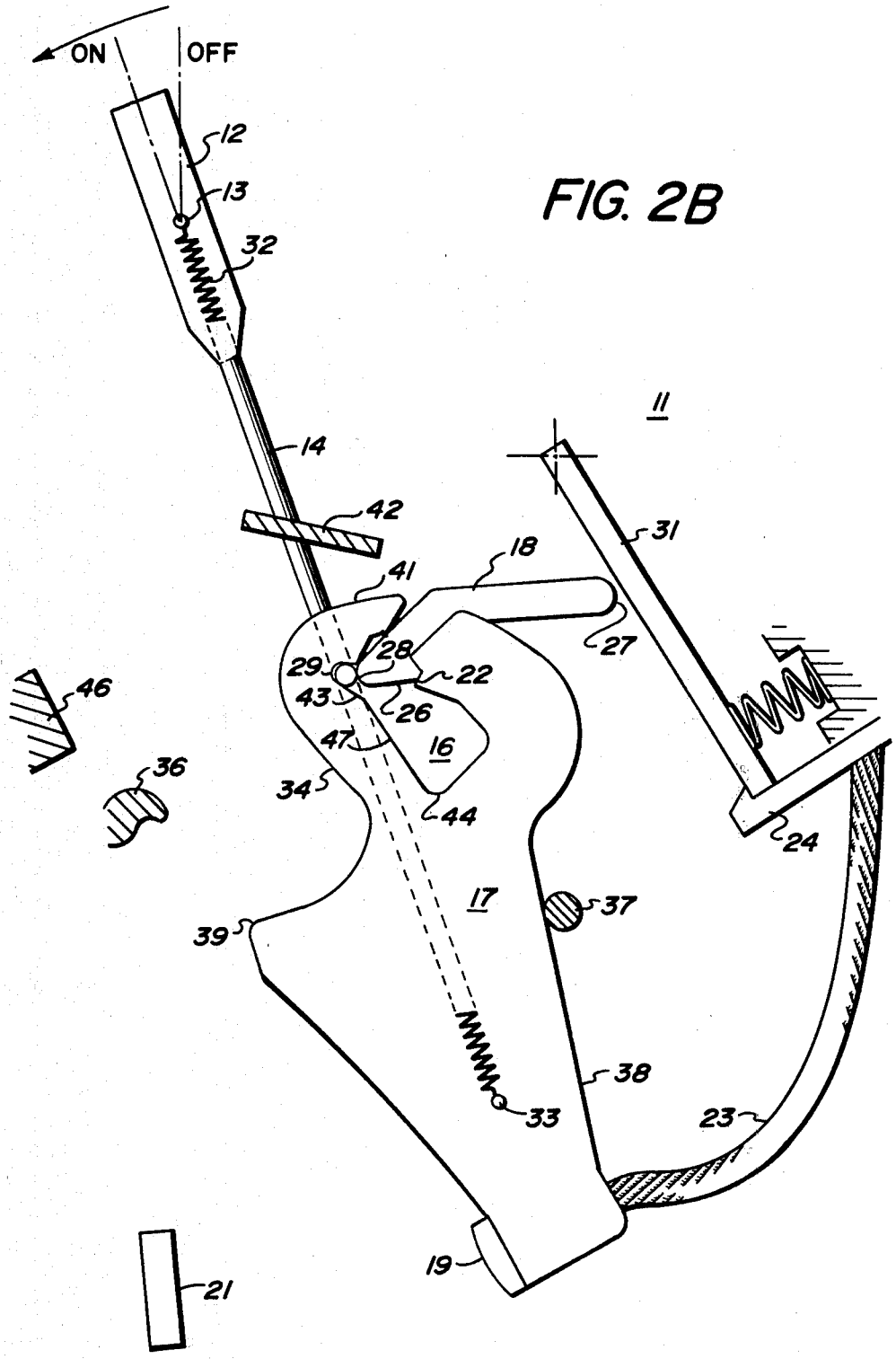
Figure 2C:
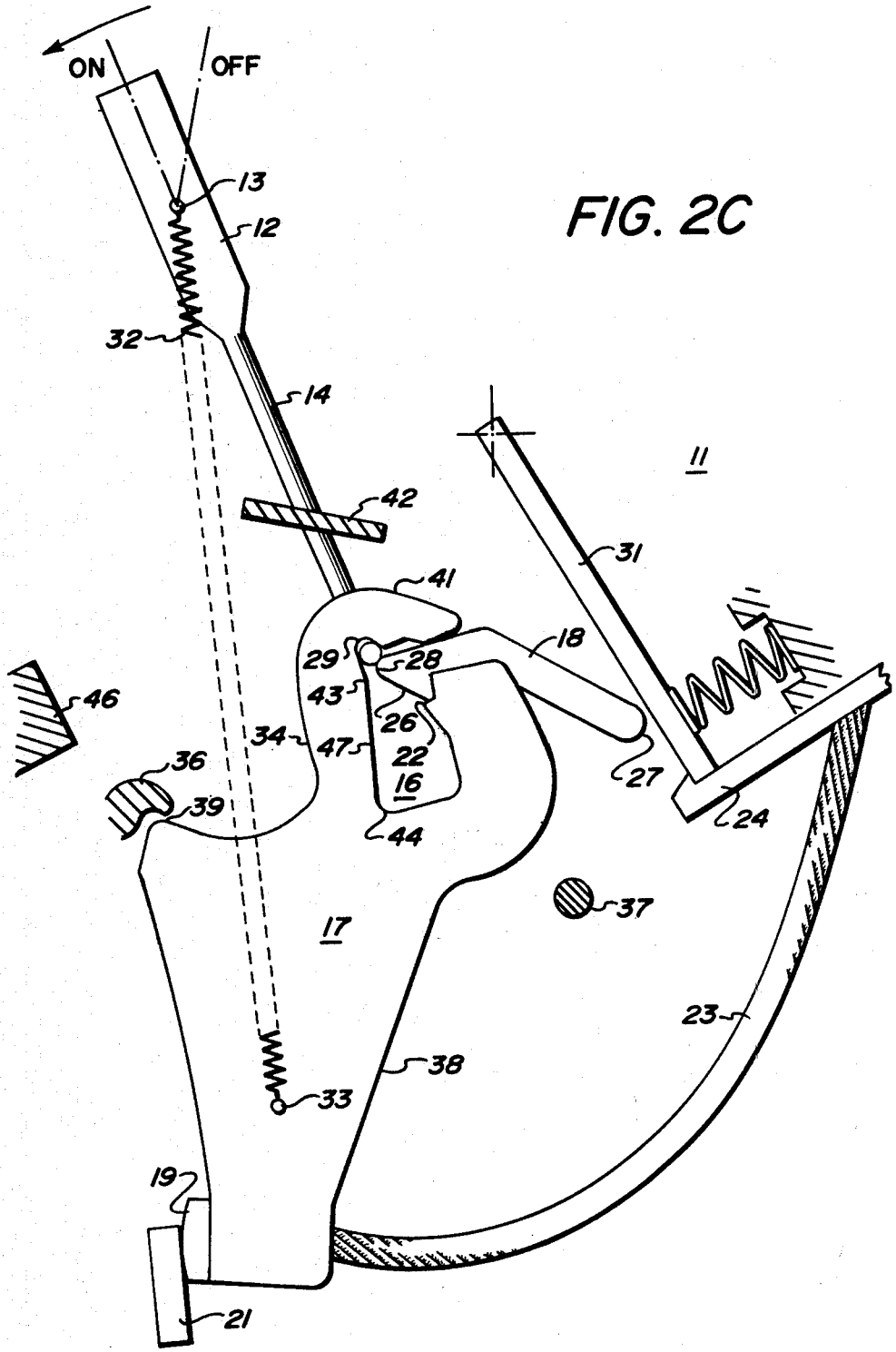

FIGS. 2A, 2B, and 2C show the mechanism in "OFF", being operated through an "overtoggling" position, to "ON", respectively. As the link 14 rotates counterclockwise (FIG. 2A), surface 38 of the contact arm 17 slides on the stop 37, rotating the contact arm 17 clockwise. An overtoggling position is reached, as shown by FIG. 2B. Further movement toward "ON" causes further rotation of the contact arm 17 about the stop 37, shifting the spring 32 force to the left and causing rapid rotation of the contact arm 17 until the contacts 19 and 21 meet (FIG. 2C).

Figure 3C:
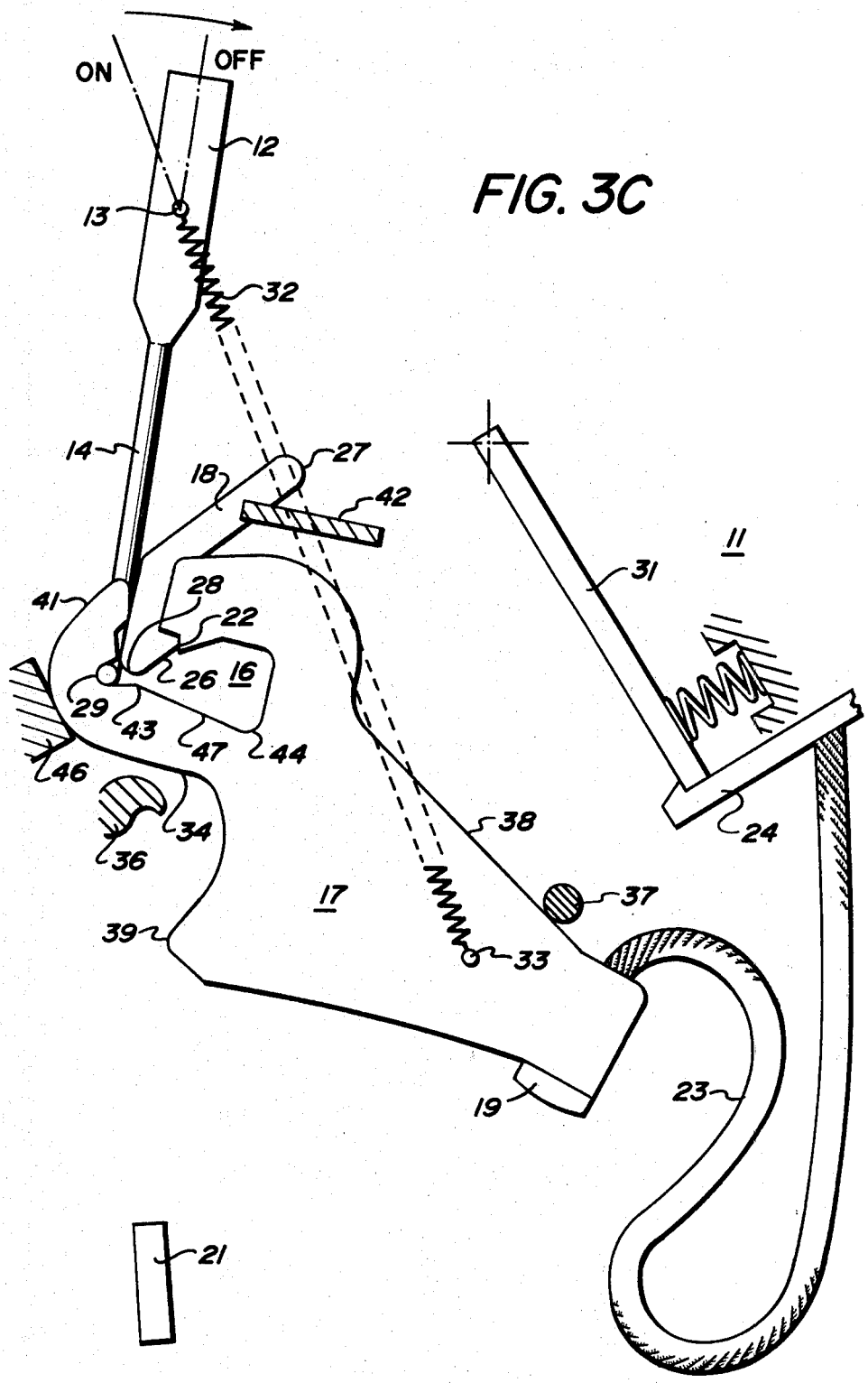

FIGS. 3A, 3BTF, 3BHI, and 3C show the mechanism operating in the tripping mode. FIG. 3A illustrates the mechanism prior to the tripping action. FIG. 3BTF shows the "trip-free" action (with handle 12 held in "ON"), and FIG. 3BHI shows "handle-indication" trip position of the mechanism, when the handle 12 is either not held or released after the mechanism tripped. FIG. 3C shows the mechanism manually reset subsequent to tripping.

Referring to FIG. 3A, there is illustrated the circuit breaker in the "ON" position. Upon existence of an over-current condition for an appropriate duration, the trip unit 24 is activated, releasing the spring-loaded pivoted member 31. The member 31 strikes the trip latch 18, causing it to pivot in the V-notch 22 of the contact arm, rotating the face 28 of the trip latch 18 until it no longer blocks the opening of the inverted U-shaped notch 29 in the contact arm 17 (dotted outline of FIG. 3A). Since the contact arm 17 is urged toward the pivot 13 by the spring 32 attached at the attachment opening 33, and is now no longer blocked from moving by the face 28 of the trip latch 18, it moves linearly toward the pivot 13 until the corner 39 touches the underside of the hook 36. At that point, the upward force along the line 33-13 makes the contact arm 17 rotate rapidly counterclockwise about the hook 36 as a pivot. The rotation brings a surface 41 of the contact arm 17 to bear against a molded ledge 42 of the housing 11. The spring 32 force at all times urges the contact arm 17 toward the pivot 13, making the arm 17 slide on a ledge 42 until the link 14—by abutting against a corner 44 of the triangular notch 16—stops the motion in the position indicated in FIG. 3BTF.

The size of the contact gap is approximately the same magnitude as in "OFF". A large gap is very desirable in preventing a re-strike after arc extinction on a shortcircuit.

When the handle 12 is released (or when it is not held), the surface 43 of the notch 16 in the contact arm 17 cams the link 14 to make it rotate clockwise about 13. This permits the contact arm 17 to move upward and to the left until the link 14 rests in corner 44 of the notch 16 and the contact arm 17 touches molded ledge 46 of the housing 11. This determines the "tripped" position of the link 14, and hence of the handle 12, at roughly the midpoint of its travel from "ON" to "OFF", giving "TRIP" indication.

Manual operation of the handle 12 from "TRIP" to "OFF" cams the contact arm 17 downward along the ledge 46, by the action of the link 14 on the edge 47 of the triangular notch 16. While the link 14 moves toward notch 29 in the contact arm 17, it causes the trip latch 18 to rotate clockwise by the camming action of the link 14 against surface 26 of the trip latch 18. When the link 14 reaches the end of its path inside the notch 29 of the contact arm 17, the trip latch 18 snaps counterclockwise, so that the face 28 of the trip latch 18 traps the link 14 within the notch 29. The mechanism is then in its relatched position, ready for switching to "ON".

Thus, in summary, the invention relates to not only the overall circuit breaker as described hereinabove, but also to the various portions of the mechanism and its basic principle of an overtoggling snap-acting linkage in which a trip-free action is obtained through the "disappearance" of the toggling pivot, collapsing the linkage.

Various modifications can be performed without departing from the spirit and scope of this invention as will be apparent to those ordinarily skilled in the art. For example, a spring loaded, trigger type, trip unit depicted peripherally hereinabove is not essential to this invention in that other modifications can be used in lieu thereof. For example, a simple bimetal element can be used for depressing the trip latch to provide the tripping action.

What is claimed is:

1. In a circuit breaker,
a housing;
a stationary contact affixed to said housing;
a handle adapted to be pivoted about a fixed pivot point of said housing;
a link extending from said handle;
a contact arm having
a pocket having at least one corner,
an attachment means, and
a projection;
a latching means adapted to normally block one corner of said pocket so as to provide an opening for reception of a portion of said link; said latching means, when actuated, adapted to unblock said one corner so as to permit said portion of said link to enter the remainder of said pocket;
a tensioning spring coupled between said attachment means and said fixed pivot point;
means affixed to said housing for providing a minimum distance between said attachment means and said pivot point;
a contact affixed to said contact arm; and
a barrier affixed to said housing;
whereby,
in a normal ON condition, said latching means blocks said one corner of said pocket, and said contacts are engaged, and
upon actuation of said latching means, said one corner becomes unblocked, permitting said portion of said link to enter said remainder of said pocket, whereupon said projection engages with said barrier, causing said contact arm to at least partially pivot thereabout, opening said contacts.

2. A circuit breaker comprising
an insulated housing having
a fixed pivot point,
a barrier fixed therewithin, and
means for limiting arcuate motion of a handle;
a stationary contact held by said housing;

a handle adapted to be pivoted about said fixed pivot point and adapted to be limited in arcuate motion by said limiting means;

a link extending from said handle;

a contact arm having a pocket having at least one corner, an attachment means, and a projection;

latching means adapted to normally block one corner of said pocket so as to provide a corner opening for reception of a portion of said link said latching means, when actuated, adapted to unblock said one corner so as to permit said portion of said link to exit from said corner opening;

a contact affixed to said contact arm;

a spring coupled to said attachment means and said housing so as to urge said contact arm toward said fixed pivot point, whereby, in a normal ON condition, said latching means blocks said one corner of said pocket, and said contacts are engaged, and upon actuation of said latching means, said one corner becomes unblocked, permitting said portion of said link to exit from said corner opening, whereupon said projection engages with said barrier, causing said contact arm to at least partially pivot thereabout, opening said contacts.

3. In a circuit breaker mechanism, a new and improved toggle mechanism including a first arm having a first coupling spot at a fixed location thereon, a second arm having a second coupling spot at a fixed location thereon, a spring coupling said first arm at said first spot to said second arm at said second spot, and means for pivoting said first arm with respect to said second arm, the improvement wherein said means, in a normal condition, provides for pivoting said first arm with respect to said second arm about a substantially fixed pivot point with respect to said second arm, and, in an actuated condition, provides for pivoting said first arm with respect to said second arm about at least one pivot point with respect to said second arm distant from said substantially fixed pivot point, and wherein neither of said spots is coincident with any of said points.

4. In a circuit breaker mechanism, an improved toggle mechanism including a first arm having a first spot at a fixed location thereon, a second arm having a channel therewithin, said second arm having a second spot at a fixed location therewithin but without said channel, a spring coupling said arms together at said spots, and means for pivotally coupling said first arm to said second arm, the improvement wherein in a normal ON condition, said first arm is pivotally coupled to said second arm about a fixed pivot point, adjacent to said channel, with respect to said second arm, and in a TRIP condition, said first arm is pivotally coupled to said second arm about at least one pivot point lying within said channel; and wherein neither of said spots is coincident with any of said points.

5. In a circuit breaker mechanism, an improved toggle mechanism including a first arm having a fixed connection point thereon and a pivotal coupling, the distance between said connection point and said pivotal coupling being a first length; a second arm having a fixed connection point thereon, and having a pivotal coupling coupled to said first arm pivotal coupling, the distance between said second arm connecting point and said second arm pivotal coupling being a second length; a spring coupling across said first arm connection point and said second arm connection point; and means operative during a normal ON condition for maintaining both said first length and said second length essentially fixed; and operative during a TRIP condition for effectively shortening at least one of said first length or said second length.

* * * * *